United States Patent [19]

Dressler

[11] 4,281,597

[45] Aug. 4, 1981

[54] INKING MECHANISM

[75] Inventor: Friedrich K. Dressler, Pawcatuck, Conn.

[73] Assignee: Harris Corporation, Melbourne, Fla.

[21] Appl. No.: 2,535

[22] Filed: Jan. 11, 1979

Related U.S. Application Data

[63] Continuation-in-part of Ser. No. 860,868, Dec. 15, 1977, abandoned, which is a continuation-in-part of Ser. No. 788,581, Apr. 18, 1977, abandoned.

[51] Int. Cl.[3] ..... B41F 31/08; B41L 27/10

[52] U.S. Cl. ..... 101/365; 101/366

[58] Field of Search ..... 101/365, 366, 364, 157, 101/169, 205, 206, 207, 208, 210, 148; 417/425, 426, 410, 420

[56] References Cited

U.S. PATENT DOCUMENTS

| | | | |
|---|---|---|---|
| 1,185,668 | 6/1916 | Hoe | 101/366 X |
| 1,707,995 | 4/1929 | Schlotter | 101/366 X |
| 2,081,906 | 6/1937 | Ball | 101/366 X |
| 2,672,812 | 3/1954 | Luehrs | 101/366 |
| 2,900,900 | 8/1959 | Harless | 101/366 |
| 3,018,727 | 1/1962 | Hegeman et al. | 101/366 |
| 3,065,693 | 11/1962 | Neal et al. | 101/366 |
| 3,134,326 | 5/1964 | Davis | 101/366 |
| 3,238,883 | 3/1964 | Martin | 417/420 |
| 3,400,658 | 9/1968 | Gagliari et al. | 101/170 |
| 3,608,486 | 9/1971 | McDonald | 101/365 |
| 3,739,721 | 6/1973 | Miarkowaki | 101/366 |
| 3,800,702 | 4/1974 | Roberts | 101/425 |

FOREIGN PATENT DOCUMENTS

| | | | |
|---|---|---|---|
| 587039 | 10/1933 | Fed. Rep. of Germany | 101/366 |

*Primary Examiner*—J. Reed Fisher

*Attorney, Agent, or Firm*—Yount & Tarolli

[57] ABSTRACT

A plurality of ink pumps are mounted directly on an ink rail. The ink pumps are gear pumps, each having a D.C. motor associated therewith. Each gear pump delivers ink to a particular section of the ink rail from which the ink is then applied to a particular circumferentially extending segment of the ink roll corresponding to a column on the page to be printed. By controlling the speed at which the motor operates, the amount of ink pumped can be varied, and thus the amount of ink delivered to the roll can be varied.

8 Claims, 16 Drawing Figures

INKING MECHANISM

RELATED APPLICATIONS

This application is a continuation-in-part of my copending application Ser. No. 860,868 filed Dec. 15, 1977, now abandoned which is in turn a continuation-in-part of my then copending application Ser. No. 788,581 filed Apr. 18, 1977, now abandoned.

BACKGROUND AND SUMMARY OF THE PRESENT INVENTION

The present invention relates to a mechanism for applying ink to an ink roll of a printing press. The mechanism is of the type which includes an ink rail which extends partially circumferentially around the roll. A plurality of pumps pump the ink into a position to be picked up by the roll as it rotates relative to the ink rail. Each pump delivers ink to a circumferentially extending portion of the roll which corresponds to a column on the page to be printed. Numerous prior art patents disclose such inking mechanisms. Typical of such patents are U.S. Pat. Nos. 3,018,727; 3,134,326; 3,400,658 and 2,672,812.

Known ink rail designs are relatively heavy and cumbersome in construction. This is due to the fact that piston-type pumps are used commonly which have a stroke adjustment for purposes of adjusting the amount of ink which is delivered to the roll. Because of their weight, the pumps are commonly mounted off the ink rail which is generally manually removable from the press. Thus, relatively long conduits, or hoses, and fittings are necessary to deliver the ink to the roll.

In addition, piston-type pumps even if mounted on the ink rail deliver a pulsing flow of ink to the ink roll rather than a continuous even flow of ink. Also, the stroke adjustments are cumbersome, and relatively complicated mechanisms are involved. in a prior art structure utilizing a single gear pump to feed from a common header individual orifices each of which is equipped with a throttle pin to regulate flow, difficulty is experienced in controlling ink flow. This results because the flow through any one orifice will be affected by the settings at the other orifices of a given page pack. The present invention overcomes this problem and facilitates control of ink flow independently of the ink flow through adjacent or contiguous orifices in a given page pack. In the improved structures hereof, an ink supply is pressurized and individual motors respectively associated with individual gear pumps meter the ink from the supply.

Another disadvantage of known ink rail constructions is that a bead of ink tends to collect at the end of the ink rail. Periodically this bead of ink will release from the end of the ink rail and be carried through the inking train. As a result an excess of ink flows through the ink train and an adverse effect on the quality of the printing occurs.

In accordance with the present invention, a substantial simplification in structure is achieved along with improved inking of the roll. A plurality of ink pumps is associated with an ink rail and specifically are mounted directly on the ink rail. The ink pumps preferably are gear pumps, each having a D.C. motor associated therewith, and which, when operating, provide a continuous output flow of fluid. Each gear pump delivers ink to a particular section of the ink rail from which the ink is then applied to a particular circumferentially extending segment of the ink roll corresponding to a column on the page to be printed. By controlling the speed at which the motor operates, the amount of ink pumped can be varied and thus the amount of ink delivered to the roll can be varied. The motor speed can be controlled or shut off electrically over a broad range to provide accurate ink feed flow rates.

A plurality of gear pump and motor units are mounted in a spaced relation along the ink rail. Each pump has an inlet passage in the ink rail and an outlet passage also in the ink rail. The porting for the gear pump is face-type porting with the inlet and outlet passages in the ink rail intersecting a face of the ink rail against which the gear pump is assembled.

Further, in accordance with the present invention, the ink rail with the gear pumps and D.C. motors secured thereon, are supported on an ink rail support and may be manually removed from the ink rail support. The ink rail is removably secured to the ink rail support by a plurality of fasteners. When released from the ink rail support, the ink rail, along with the pumps and motors, may be removed as a unit since the assembly is relatively light weight.

Also in accordance with the present invention, the various gear pumps are assembled in so-called page packs, each of which corresponds to a page being printed in the printing press. Each page pack has a valve for delivering the same fluid to all of the gear pumps of the page pack. Along each inking roll there may be a plurality of page packs so that a plurality of different colored inks could be applied to the same roll at the same time. The valve associated with each page pack may be adjusted to deliver black ink to all of the gear pumps of the page pack, or to deliver colored ink to all of the gear pumps of the page pack. Also, for purposes of cleaning the ink roller and gear pumps, a cleaning solvent may be delivered through the valve to the ink roll. Accordingly, the valve has three inlets and one outlet which communicates with the gear pump through passages in the ink rail.

A problem which may be encountered when feeding several pumps from a single manifold conduit in the ink rail is starvation of those pumps remote from the ink inlet to the single manifold conduit. To overcome this problem, a preferred embodiment of the invention includes a large manifold chamber connected to the ink supply and individual conduits extending from the manifold chamber to each pump.

Further, the output of each gear pump is directed through an orifice located adjacent to the periphery of the ink roll. As the roll rotates past the orifice, ink is ripped out of the orifice and essentially is accelerated from zero speed to press speed. This action is believed to result in a heating of the ink and is believed to be a direct cause of the buildup of ink at the end of the ink rail in the prior art structures. It has been discovered that by providing a recess in the ink rail adjacent to the roller and which recess is located downstream of the orifice, the collection ink at the end of the ink rail is substantially minimized. It is believed that the recess gives the accelerated ink a chance to cool after it has been ripped from the orifice by the roll. As a result of this cooling, it has been found that buildup of ink on the end of the ink rail is minimized.

Experiments have shown that the average ink volume requirement on each column of a newspaper at a minimum press speed of 500 ft/min. is in the range of from 2–8 cc of ink/minute. For commercial application, flow requirements may be as low as 0.1 cc/min. per pump. Only one pump on the page pack of 8 pumps may be running at such a delivery rate. Others may be off entirely, or they may be running at a higher rate. The range required for commercial use is from 0.1 to 60 cc/min. Under such extreme requirements, a further problem occurs with D.C. drive motors for the pumps. With common D.C. motors driving the gear pumps for feeding the ink, the lowest reasonable speed is about 500 RPM. Below this value, the motor stalls or runs erratically and control is lost.

D.C. motors normally require a certain minimum voltage in order to begin running. To achieve the required range of ink delivery, accommodate variation in press speed on commercial offset presses, and provide minimum starting voltage, a pulsing circuit has been devised. Pulses of a predetermined width energize the motors, and the number of pulses per unit time is controlled by a press speed responsive voltage control oscillator. Each ink pump has, therefore, individual control as well as page control to increase or decrease ink supplies by 8 individual pumps normally feeding one printed page per block. Separate power supplies are desirably used for the pump drive and for the electronics to avoid noise spikes in the electronics. Remote electrical read out and control is available with the present improved system and not with the piston pump systems.

DESCRIPTION OF THE FIGURES

Further features of the present invention will be apparent to those skilled in the art to which the present invention relates from the following detailed description of preferred embodiments thereof made with reference to the accompanying drawings in which.

DESCRIPTION OF THE PREFERRED EMBODIMENTS

As noted hereinabove, the present invention relates to an inking mechanism for depositing ink on a roll of an ink train of a printing press. Specifically, the present invention relates to the type of mechanism which is termed an "ink rail" in which ink is pumped into a rail which extends circumferentially around a portion of the ink roll. The roll strips the ink from the ink rail as the roller rotates.

The present invention provides in particular an ink control module which is of a page pack size and is of a compact and unique design. It is constructed to enable easy and accurate column control of ink either by manual or automatic control. It is relatively easy to maintain, has minimum hoses and fittings and has an automatic clean and purge system associated therewith. The present invention may be embodied in different specific structures and the preferred embodiments illustrated and described below are merely representative of the present invention.

Figure 1:
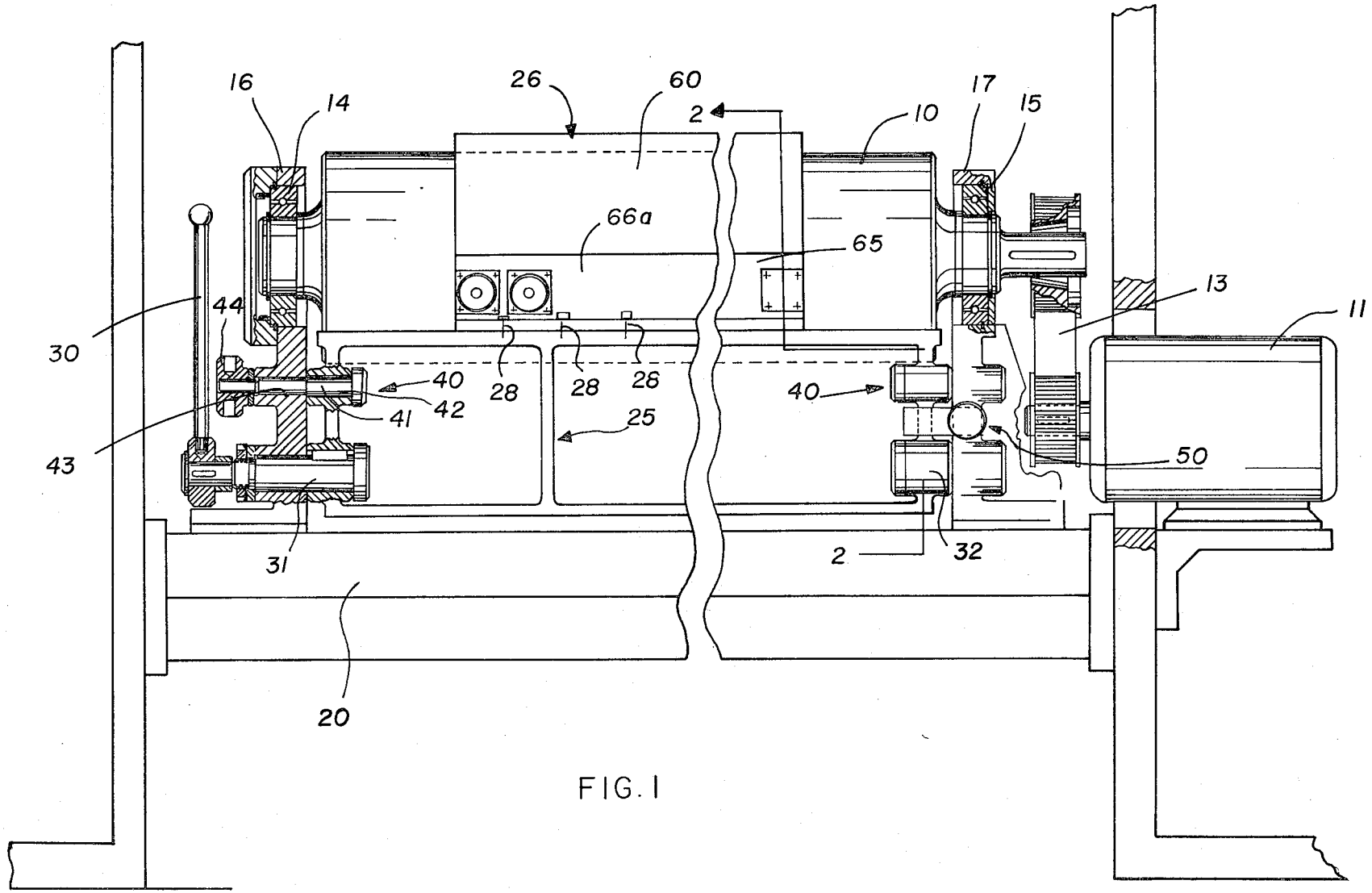
FIG. 1 is a view partially in section and partially broken illustrating a mechanism embodying the present invention.

As shown in FIG. 1, the present invention is used to deliver ink to an ink roll 10 forming a part of an ink train of a printing press. The structure illustrated in FIG. 1 is a conversion unit applying the present invention to an existing printing press. As a result, the roll 10 is driven from a motor 11 through a timing belt 13. The roll 10 could be driven from the gearing of the printing press but since the illustrated embodiment is a conversion unit for a printing press, a separate motor 11 is provided for driving the roll 10. The roll 10, of course, is in ink-transferring relationship with other rolls (not shown) in the ink train of the press, which rolls deliver ink to the plate cylinder of the printing press. The roll 10 commonly would run against a vibrator roll in the inking train.

The roll 10 is supported at its opposite ends in bearings 14, 15 which are located in arms 16, 17 respectively. As shown in FIG. 1, arm 16 is located on the left side of the roll 10 and extends downwardly and is suitably fixed at its lower end to a frame member 20. The arm 17 likewise extends downwardly and also is fixed at its lower end to the frame member 20. The inking mechanism for applying ink to the roll 10 includes an ink rail support or bridge, generally designated 25. The ink rail support is located between the arms 16 and 17. The ink rail support 25 carries or supports a plurality of ink rails or page pack assemblies generally designated 26. The page pack assemblies 26 are supported in longitudinally spaced relation along the length of the roll 10. Each page pack assembly 26 is removably secured to the upper surface of the support rail 25 by a plurality of bolts 28 (shown schematically). Removal of the bolts 28 enables the entire page pack assembly to be manually lifted from the ink rail support 25.

When the page pack assemblies 26 are located and secured to the ink rail support 25, the page pack assemblies and support may be manually moved toward and away from the ink roll 10. Preferably, for this purpose, a handle 30 is located at each axial end of the roller 10. Only one handle 30 is illustrated in the drawings on the left side of the roll 10. The handles 30 are fixedly connected to stub shafts 31, 32. The stub shafts 31, 32 are rotatably supported in openings in the arms 17, 17 respectively. Movement of the handles 30 results in the shafts 31, 32 rotating about their axes relative to arms 16, 17. The shafts 31, 32 are fixedly connected to the ink rail support 25 and upon movement of the handles 30, the ink rail support 25 will pivot about the axis of the stub shafts 31, 32.

The ink rail support 25 may be secured in any position in which it is pivoted by means of suitable fastening arrangements, designated 40 and located at opposite axial ends of the roll 10. Only the fastening arrangement 40 at the left end of roll 10 is illustrated in detail on the drawings and will be described. The fastening arrangement 40 at the right end of the roll is of identical construction.

The fastening arrangement 40 comprises a pin 41 which extends through a hole 43 in the arm 16 and into a curved slot 42 in support 25. The slot 42 best shown in FIG. 2, has a curvature with the center of the pin 31 being the center of the curvature. The pin 41 is threaded at one end and a threaded locknut 44 engages the pin 41. By threading the nut 44 into engagement with the pin 41, the ink rail can be secured in any given position as desired. From the above, it should be apparent that upon loosening of the locknut 44 and movement of the handle 30, the various page pack assemblies mounted on the ink rail support 25 can be moved toward or away from the ink roll 10. This movement being permitted by the fact that the pin 41 is located in the slot 42 in the arm 16 and thus does not interfere with such movement.

Figure 4:
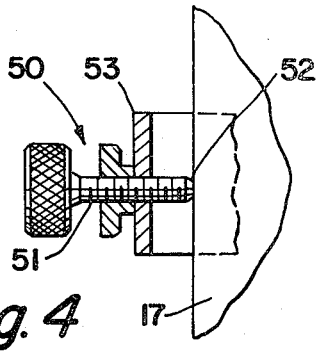
FIG. 4 is a sectional view taken along line 4—4 of FIG. 3.

A suitable stop arrangement generally designated 50 is provided on both sides to prevent excessive movement of the page pack assemblies toward the roll 10. The stop arrangement (see FIG. 4) comprises a stop screw 51 which has a stop surface 52 for engagement with a surface of the arm 17. The stop screw 51 is mounted and secured to an L-shaped plate 53 which has one leg of the L bolted to the ink rail support 25. The stop screw 51 is threaded into the other leg of the L.

When the ink rail support 25 moves toward and away from the roll 10 the plate 53 and stop screw 51 likewise move. When the surface 52 of the stop screw 51 engages the arm 17 movement stops. It should be clear by adjustment of screw 51 the inwardmost position of the page pack assemblies can be adjusted.

Each of the page pack assemblies 26 includes an ink rail portion 60 which is curved to the circumference of the roll 10 and carried by a manifold portion 65. The ink rail portion 60 has a plurality of circumferentially spaced passages 61 which are formed in the ink rail 60 and are curved around the periphery of roll 10. The passages 61 are adapted to receive the ink as will be apparent from the description below. Ink is delivered to the passages 61 through an outlet passage 70 in the ink manifold 65 from a gear pump 62 driven by a D.C. motor 63.

A plurality of gear pumps 62 is provided in each page pack. Each gear pump has an outlet passage 70.

Figure 5:
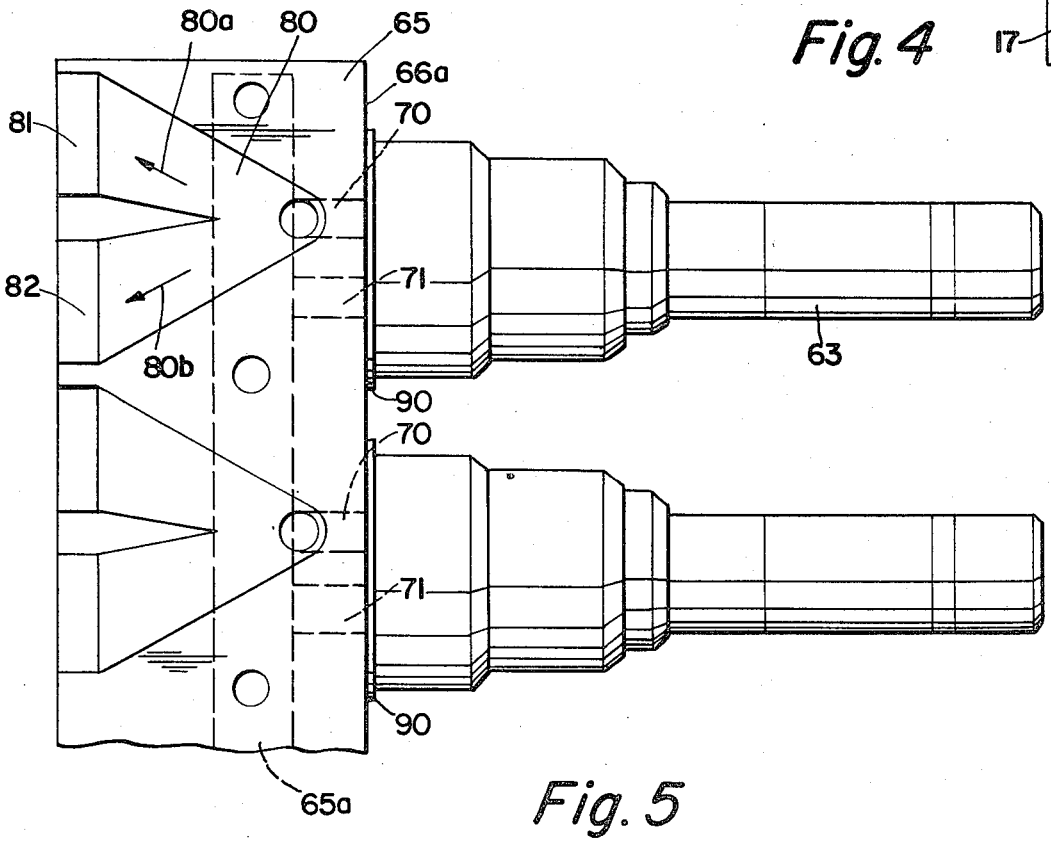
FIG. 5 is an enlarged view taken approximately along the line 5—5 of FIG. 2.

Each outlet passage 70 (see FIG. 2) communicates with a horizontally extending passage 80. The flow in the passage 80 is divided by a flow directing wedge 80*c* (FIG. 5) which directs the flow into two flows indicated by arrows 80*a*, 80*b* in FIG. 5. These flows are received in orificies 81, 82 located adjacent to the periphery of the roll 10. The roll 10 as it rotates past orifice 81, 82 rips the ink from the orifices 81, 82 and accelerates the ink flow from zero to press speed and carries the ink into the passages 61. The wedge 80*c* extends circumferentially around the roll 10 and the ink delivered through orifices 81, 82 becomes deposited on the roll 10 in spaced strips. The vibrator roll in the ink train (not shown) acts to spread the ink longitudinally so that a film of ink is provided throughout the roll.

Figure 2:
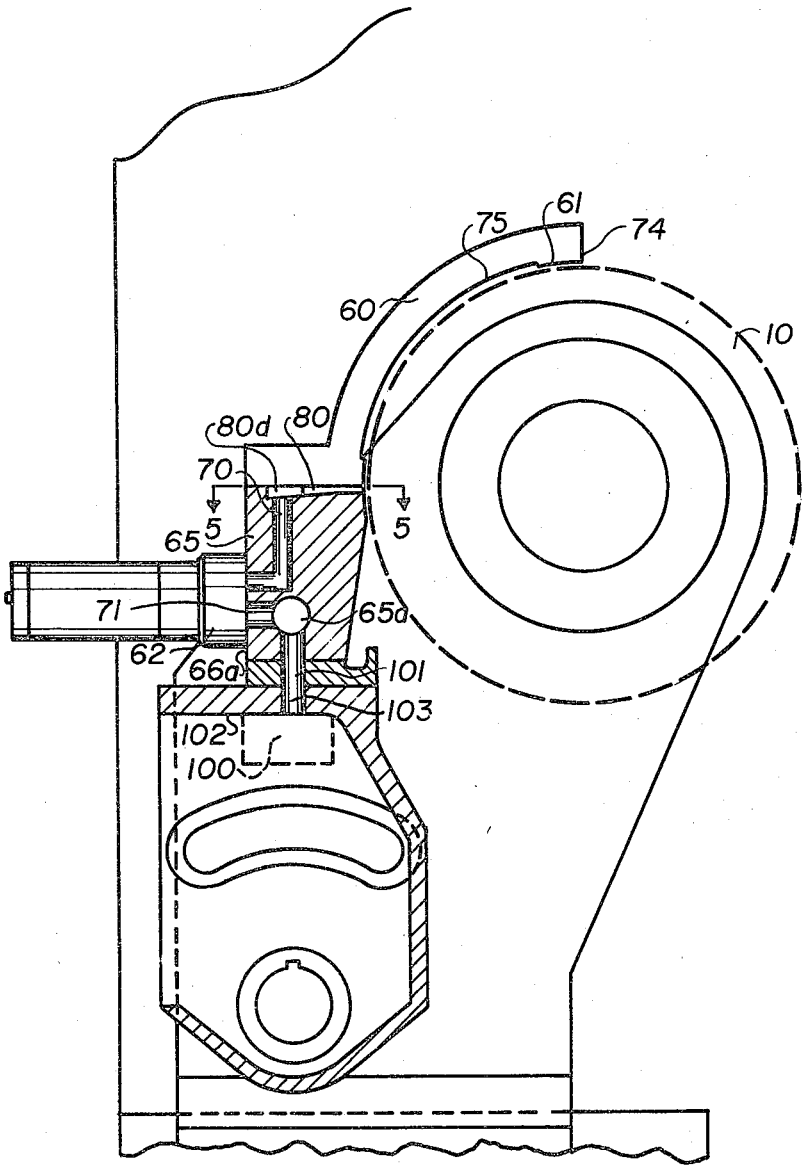
FIG. 2 is an enlarged view taken approximately along the line 2—2 of FIG. 1.
Figure 3:
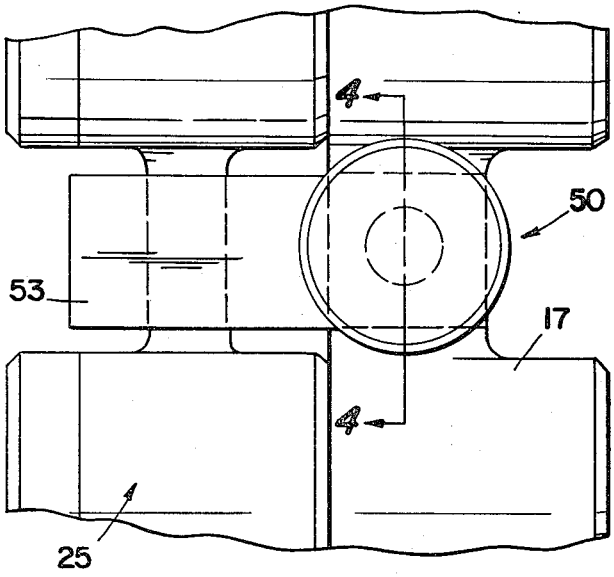
FIG. 3 is an enlarged fragementary view of a portion of the structure shown in FIG. 1.

Each horizontally extending passage 80 has a portion 80*d* located below the level of the orifices 81, 82 as best shown in FIG. 2. This portion 80*d* acts as a reservoir and pressure compensator and minimizes "bleeding" of ink onto the roll 10 if the press is stopped.

As noted above the ripping of the ink out of the orifices 81, 82 results in a substantial heating of the ink. The ink tends to adhere equally to the fast moving ink roll 10 and the ink rail surface and is split, with part of the ink moving with the roll and part moving up the ink rail surface. These actions also result in further heating of the ink making it quite fluid. In particular, the ink immediately adjacent to the ink rail surface is particularly subject to heating due to friction between the ink and the rail surface. This has resulted in the past in this fluid portion forming a bead at the end 74 of the ink rail 60. This bead gradually increases in size until large enough and cooled enough to stick to the roll. When this bead releases from the ink rail 60 an excessive amount of ink flows through the system and a dark spot results on the print. The present invention minimizes this problem by providing an axially extending recess or cavity 75 formed in the ink rail and specifically in each of the passages or gaps 61 and 61*a*. The cavity 75 reduces the formation of the bead on the leading end of the ink rail. This is believed to be due to the fact that the ink can cool in the cavity 75. As a result, the problem of a bead of ink releasing from the ink rail and moving down through the ink train is avoided by the present invention.

The ink manifold 65 of each page pack assembly has the gear pumps 62 supported thereon. Specifically, the gear pumps 62 are supported on a surface 66*a* of the manifold 65. The manifold 65 of the embodiment shown in FIGS. 2 and 6 has a common inlet passage 65*a* which extends axially through the manifold 65. The common inlet passage 65*a* is adapted to receive ink from a suitable supply. A suitable valve 100 controls the flow of fluid into the common inlet passage 65*a*. Inlet passageways 71 communicate with the common passage 65*a* and also communicate with the inlet of respective gear pumps 62. The gear pumps 62 draw ink from the inlet passageways 71 and force ink into the outlet passages 70.

Figure 7:
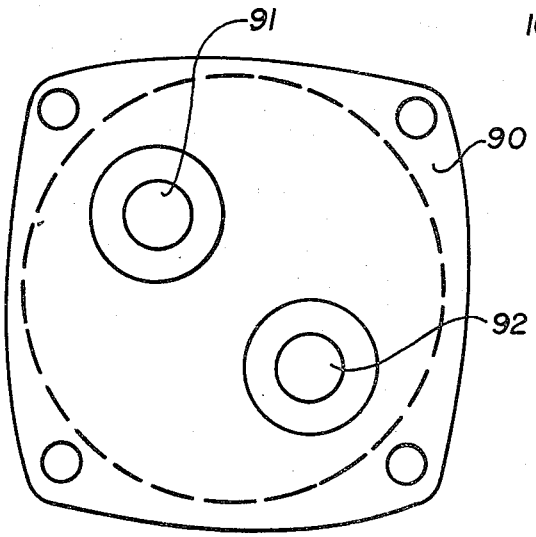
FIG. 7 is a view taken on the line 7—7 of FIG. 6.

As noted above, each gear pump 62 is mounted on a face surface 66*a* of the ink manifold 65. In particular, the inlet passages 71 and outlet passages 70 intersect the face 66*a* of the manifold 65. A port plate 90 for each gear pump 62 (see FIGS. 7 and 14*a*) engages the face 66*a* and ports fluid into and out of the pumping chamber of each gear pump 62. The port plate 90 includes an inlet port 91 and an outlet port 92. The pumps 62 and port plates 90 are fixedly secured on the face 66*a* of the manifold 65. Each pump 62 has its individual drive motor 63. The small diameter of the pump/motor units make possible lining up 28–32 such units in a 60" length (4 page packs of 7–8 columns).

Associated with each page pack 26 is a valve 100 which controls the flow of fluid into the common passage 65*a* of each page pack. The valve 100 is face mounted on the rail support 25. The valve has three inlets, 110, 111, 112 and one outlet, 114. The outlet 114 is adapted to communicate with a vertically extending passage 101 in the ink manifold 65 to deliver ink or fluid to the common passage 65*a*. The valve is face mounted on the face 102 of the rail support 25 which has a passage 103 communicating with the passage 101 in the ink manifold 65.

The inlet 110 (see FIG. 8) is in fluid communication with a supply 120 of black ink. The inlet 111 is in fluid communication with a supply 121 of colored ink. The inlet 112 is in fluid communication with a supply 122 of cleaning solvent.

Each valve 100 has a movable part 125 which can be moved to different positions in order to communicate either inlet to the outlet. The part 125 may be manually moved, a handle 126 being provided therefor. Also, the part 125 may be moved by a suitable stepping motor not shown.

Figure 8:
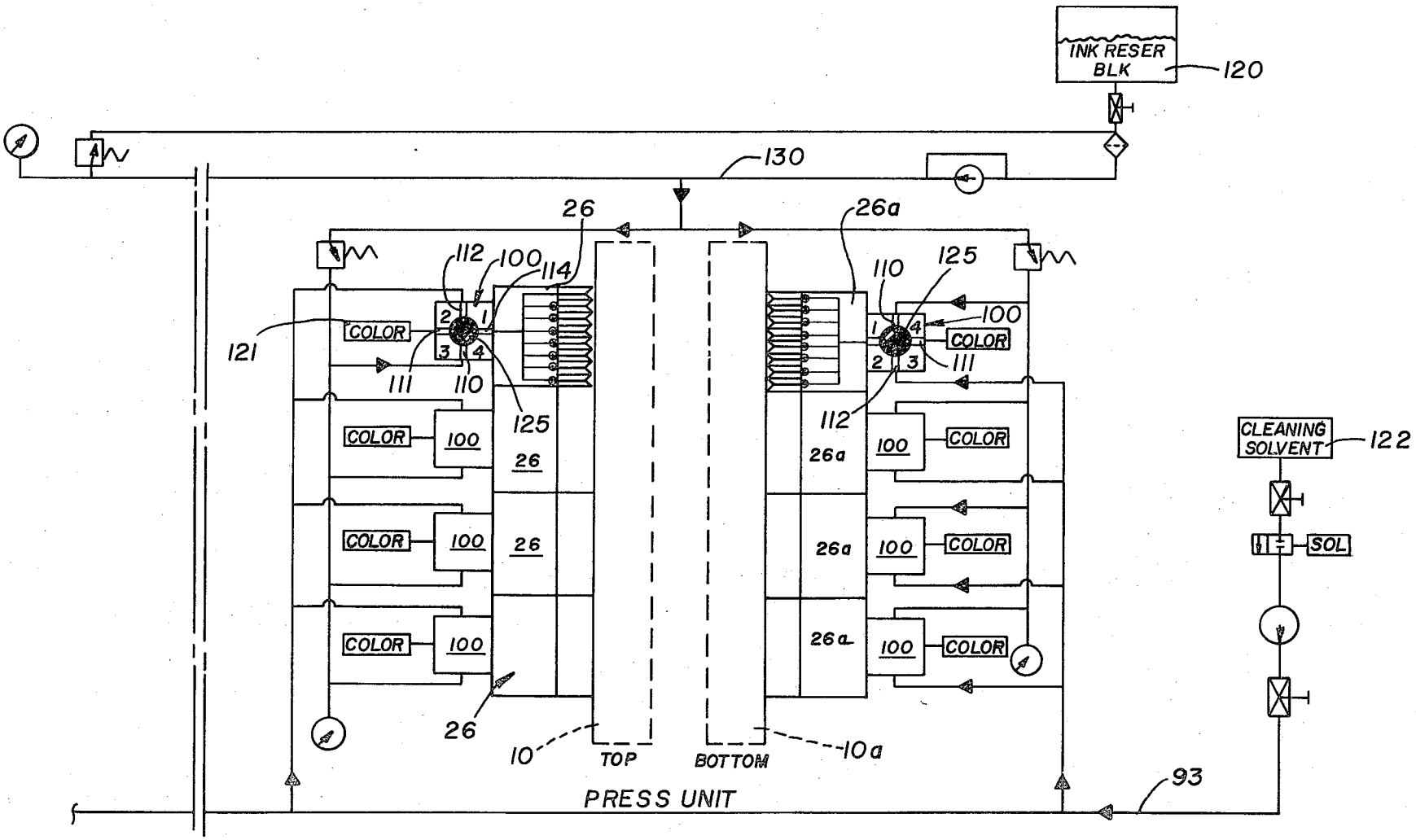
FIG. 8 is a schematic fluid circuit illustrating a system embodying the present invention.

FIG. 8 illustrates a system embodying the present invention for a blanket to blanket perfecting press having upper and lower plate cylinders and thus upper and lower inkers. The inker for the upper and lower printing units are designated top and bottom. As shown therein page pack assemblies 26 four in number are associated with the upper inking roll 10 and a plurality of page pack assemblies designated 26*a* are associated with the lower inking roll designated 10*a*. A valve 100 is associated with each page pack assembly and may be set to direct black ink to each page pack assembly or may be set to direct colored ink to each page pack assembly. For example, in the position of the valves 100 illustrated, the valve is directing black ink into the page pack assemblies.

As shown in FIG. 8 the inlet port 110 communicates with the black ink supply 120 through conduit designated 130. Upon movement of a valve to a position where the inlet communicates with the outlet 114 the page pack assembly would then receive ink from the colored ink reservoir 121. Further by moving the valve to a position where the outlet 114 communicates with the inlet 112, cleaning solvent from the cleaning solvent reservoir 122 is directed through conduit 93 into the page pack assembly to effect a cleaning thereof. The smaller ink volume in the gear pumps compared to piston pumps saves ink and facilitates cleaning on color change.

The ink rail assembly includes means defining a trough 130. The trough receives solvent that runs off of the roll 10 during cleaning of the roll.

In FIGS. 9–12 there is shown another embodiment of an ink rail of the present invention. As indicated above, a problem sometimes encountered with a single manifold line, e.g. the line 65*a* in FIG. 5 feeding several pumps, is starvation of certain of the pump units. Specifically, a pump unit remote from the ink inlet to the line may not receive a sufficient amount of ink because the other pumps draw off the ink before it reaches the remote pump.

To overcome this difficulty, manifolding such as shown in FIGS. 9–12 is used. In general, a central manifold is provided with individual conduits leading to individual ink pumps. Thus, the fluid pressure at entry into the individual conduits is close to the same for each pump, and no pump is starved.

Figure 9:
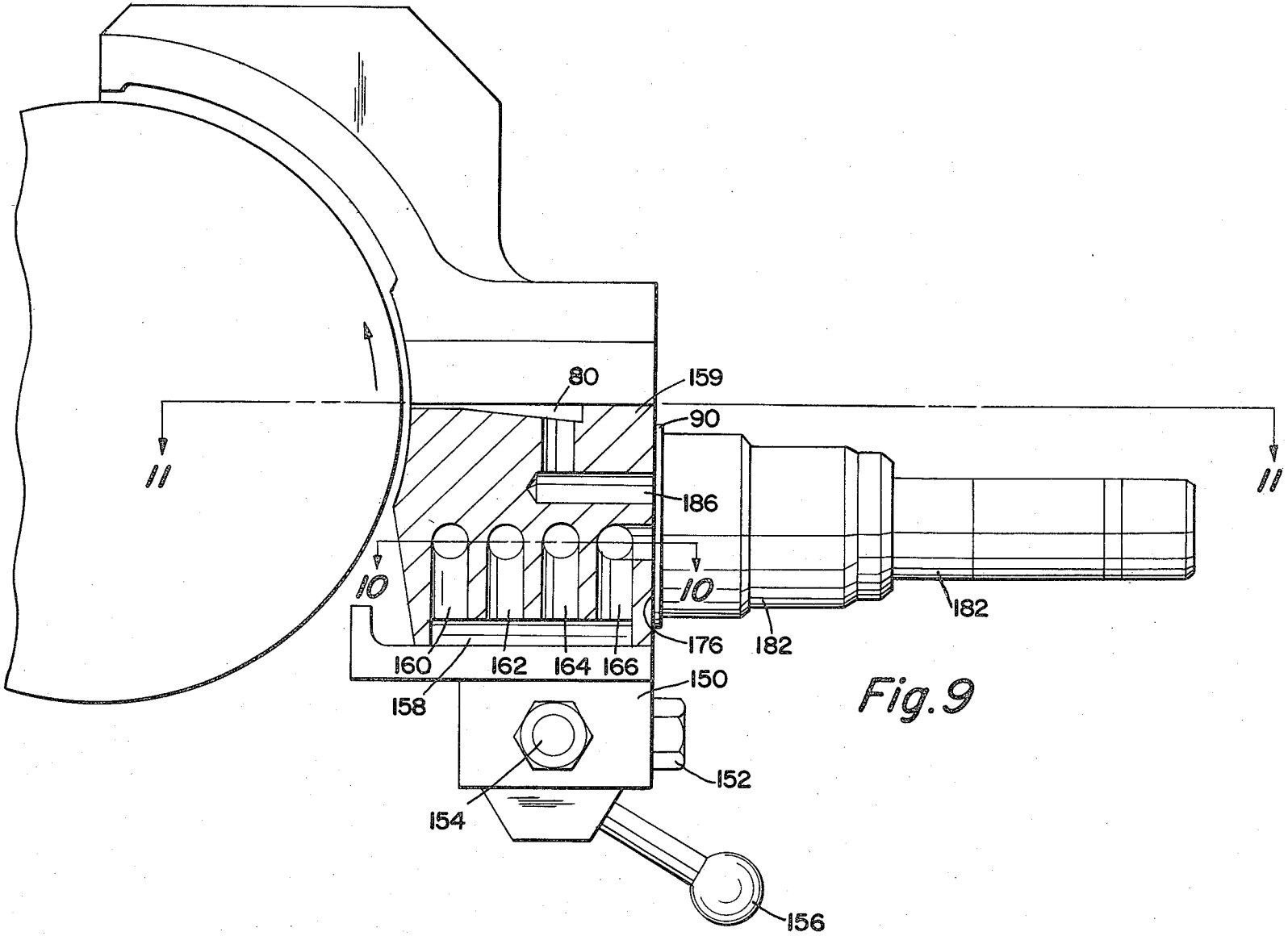
FIG. 9 is a view in partial cross-section like FIG. 6 showing an improved embodiment of the present invention.
Figure 12:
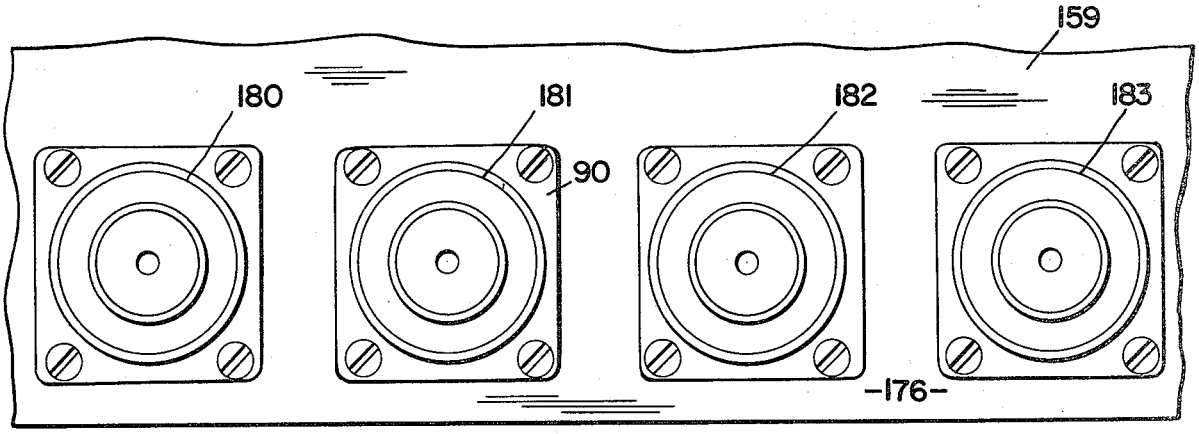
FIG. 12 is a view partially broken away of a plurality of ink pumps of the present invention.
Figure 10:
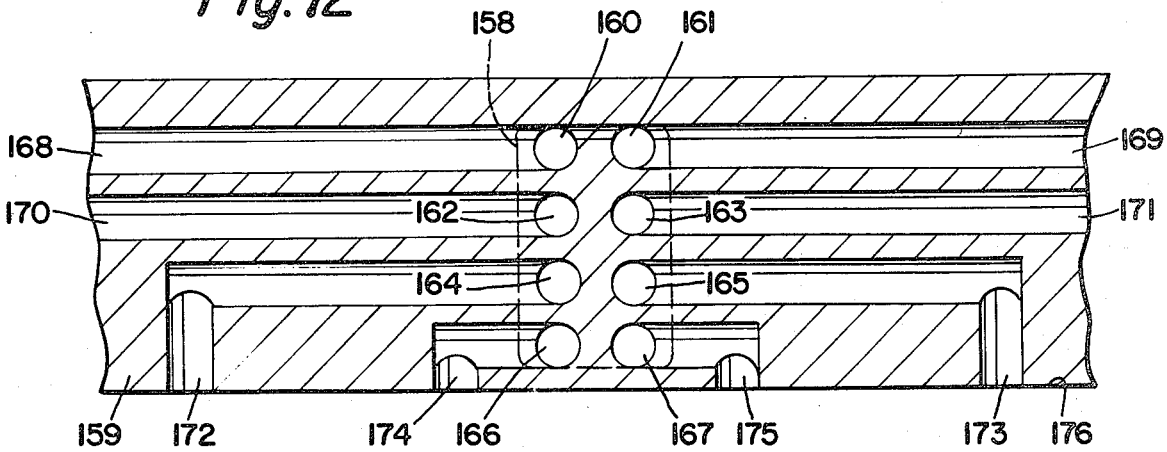
FIG. 10 is a cross-sectional view of the ink rail as it appears in the plane indicated by the line 10—10 in FIG. 9.
Figure 11:
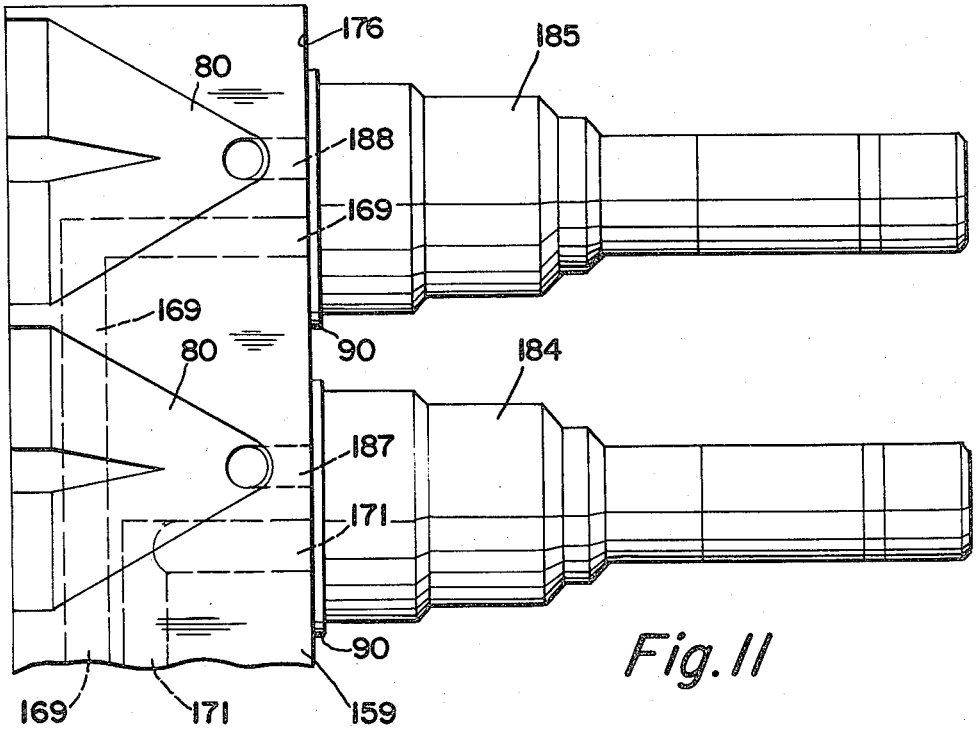
FIG. 11 is a cross-sectional view of the ink rail and pump assembly as it appears in the plane indicated by the line 11—11 in FIG. 9.

As shown in FIG. 9, an inlet flow control valve 150 has a main inlet 152 for, say, black ink. A second fluid inlet 154 is conveniently provided for solvent (utilized in cleaning the ink rail and pumps), or for the substitution of a different color ink as described in connection with FIG. 8. The directional valve 150 is adapted for manual operation by a throw handle 156. The outlet from the valve 150 opens into a central manifold chamber or reservoir 158, in the ink rail 159.

Manifold chamber 158 is provided with eight outlets, e.g. 160, 161, 162, 163, 164, 165, 166 and 167. The eight outlets communicate with eight individual ink pumps of a page pack. Each of the outlets 160–167 communicates with a respective individual conduit 168–175 extending from the manifold chamber 158 to the individual ink pumps. Specifically, the opening 160 communicates with a series of internal bores in the ink rail defining a conduit 168; opening 161 communicates with conduit 169; opening 162 communicates with conduit 170; opening 163 communicates with conduit 171 etc. Each of these conduits is connected with a respective pump.

The manifold chamber 158 is desirably centrally located on the ink rail 159. The isolated conduits 168, 169, then, are conveniently of the same length and lead to the opposite ends of the ink rail 159. Conduits 170, 171 are likewise of equal length albeit shorter than conduits 168, 169. The outlets of the conduits 168–175 are on the face 176 of ink rail 159 and are uniformly spaced and located for entry of ink or solvent issuing thereform into the inlets of respective ink pumps, only six pumps being shown and designated 180–185. It will be understood that an individual ink pump is provided for each column, and that the number of columns usually 8 to a page pack is a matter of choice.

Figure 6:
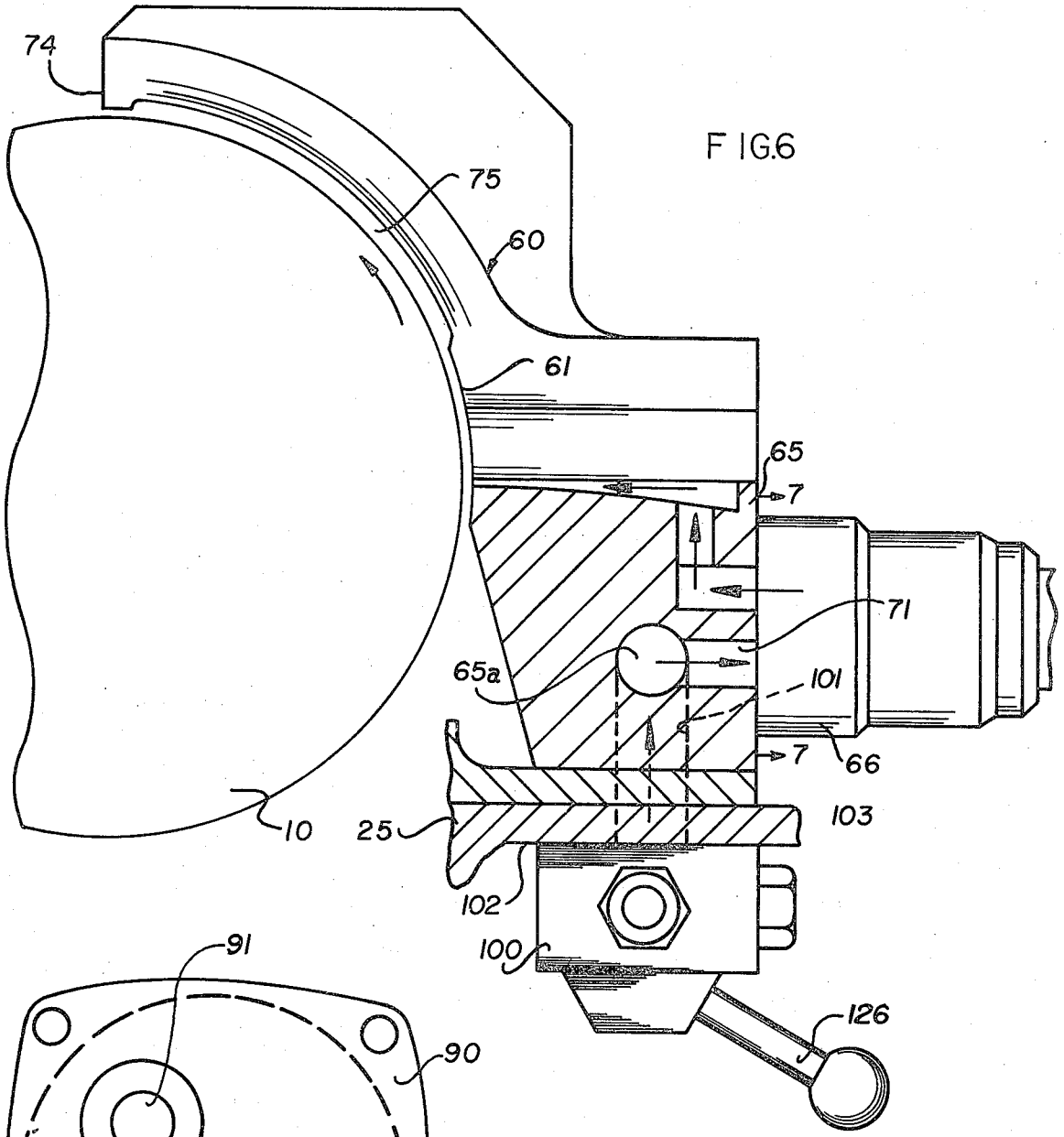
FIG. 6 is an enlarged view of a portion of FIG. 2.

Also provided in ink rail 156 are individual bores or feed conduits communicating the pump outlet with a horizontally extending passage 80 as in the embodiment of FIG. 6. The outlets shown in the drawings are designated 186, 187, 188. The outer outlets are not shown.

The ink pumps, e.g. pumps 180–185 are face mounted on the face 176 of ink rail 156 with their inlet and outlet ports in juxtaposed registry with the conduits in the ink rail. The pump inlets communicate with a respective passage 168–175 and the pump outlets communicate with passages such as 186–188. Thus, each pump is provided with its own supply of ink from a common manifold chamber 158 and delivers ink through a feed conduit having the same length as every other feed conduit. A pump that is running at a relatively high speed due to high ink demand will not now cause ink starvation for an adjacent pump. Better delivery of ink is obtained in this way resulting in better ink control, particularly at the ends of the ink rail.

The speed of each ink pump motor is individually controllable and the quantity of ink delivered for any given printed column can be adjusted in accordance with the ink desired for that column by adjusting the speed of the motor. This adjustment can be made automatically or manually. Still further, as the speed of the press varies, the amount of ink supplied a given pump may be varied in direct linear proportion.

Figure 13:
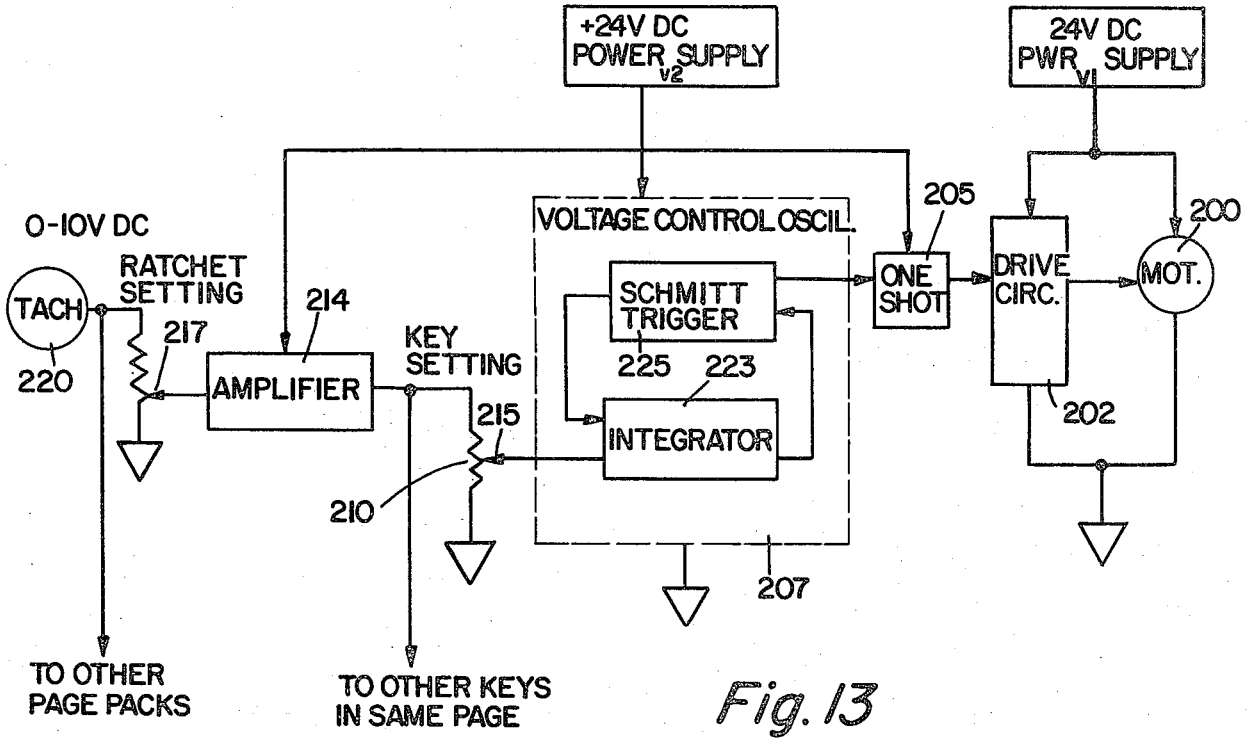
FIG. 13 is a block diagram of an ink pump pulsing circuit used in the present invention.

In a specific embodiment, a gear pump 410 was rotated at 0.1014 cc. per revolution. From 0.1 to 60 cc. per minute may be provided by each pump. Specific means for accomplishing the speed control are shown in FIG. 13, and in greater detail in the aforesaid commonly owned application Ser. No. 860,867.

As noted above, the flow demands on the gear pumps extend over a wide range. When it is desired to provide a very low flow rate from a gear pump, there is a tendency for a D.C. motor to stall. In order to avoid any stalling of the motor at lower rpm's and still provide for a continuous output from the gear pump, a pulsing circuit, as shown in FIG. 13, is preferably utilized for driving the individual motors for the pumps.

The pulsing circuit is constructed so that each motor is energized by periodic pulse for a constant period so that its pump, during each period, delivers a predetermined constant amount of ink. Increases or decreases in the amount of ink required from a given pump are provided by controlling the interval between pulses. An arrangement for accomplishing such control and enabling control of ink over a wide range of flow rate is shown in FIG. 13.

As shown there, each pump 200 is energized by a drive circuit 202 during the period of a one-shot 205. The one-shot is fired at intervals determined by the repetition rate of pulses from a voltage controlled oscillator 207. The input voltage controlled oscillator 207 is from an individual pump potentiometer 210. The control voltage for potentiometer 210 as well as for corresponding potentiometers of the remaining pumps for the same page pack is provided by amplifier 214. The portion of the control voltage selected by wiper 215 of the potentiometer may be determined for each pump individually to establish a base flow rate for that pump in a given run. The input to amplifier 214 is from a page pack potentiometer 217 which may be set to provide a common base flow rate signal for the set of eight page pack pumps. The control voltage to potentiometer 217 is from the press tachometer 220 and that signal is provided to all page pack potentiometers.

In operation, potentiometers 217 and 210 will be set according to the requirements for ink flow rate from the block of page pack pumps and the individual pump 200, respectively. Voltage controlled oscillator 207 includes an integrator 223 which produces a ramp signal having a slope proportional to the signal at its input. When the signal reaches a predetermined value a Schmitt trigger 225 is fired and discharges integrator 223 as well as firing one-shot 205. The one-shot produces a pulse of predetermined time duration to drive motor 200 through drive circuit 202.

A change in the speed of the press will produce a corresponding change in the output of amplifier 214 and the input to voltage controlled oscillator 207. This change results in a corresponding change in the repetition rate of pulses to one-shot 205 and in the intervals at which motor 200 is energized.

At relatively high press speeds and/or at key settings requiring relatively high output from a gear pump, the pulses delivered to the drive circuit 202 for that gear pump will be at such a rate that the motor 200 will operate in substantially a continuous manner and will drive the gear pump with which it is associated in a continuous manner, and therefore a continuous flow of ink will flow from the gear pump. At low press speeds and/or key settings requiring a small amount of ink from the gear pump associated with a particular motor, the motor will be operated in a pulsed manner so that the flow from the gear pump with which the motor is associated will be in pulses. However, there will be a sufficient supply of ink for delivery in a continuous manner to the roll so that the proper quantity of ink is supplied to the roll.

Figure 14:
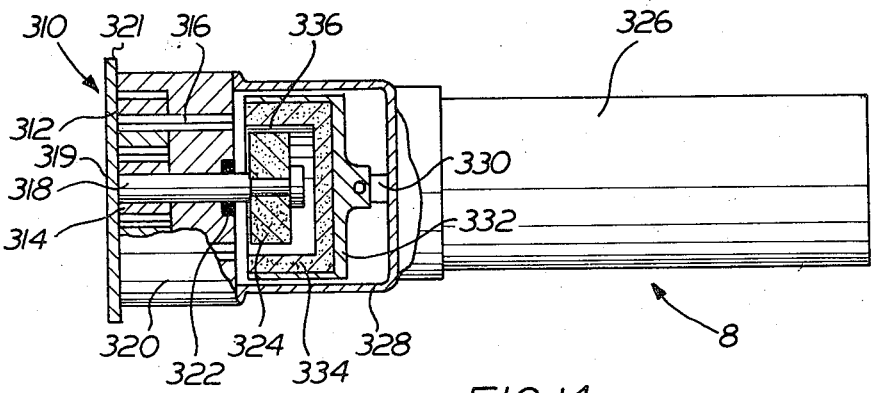
FIGS. 14 and 14*a* show a partially cut away view of a gear pump and motor unit useful with the present invention, and an end view thereof, respectively.
Figure 14A:
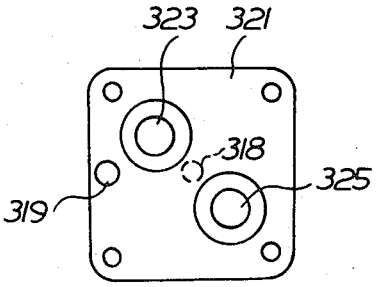

A pump and motor unit which is particularly useful in feeding printing ink through the ink rail is shown in FIG. 14. In FIGS. 14 and 14*a*, there is shown a preferred embodiment of an ink pump/motor assembly 308 in partial cross section. The assembly 308 includes a gear pump 310 having gears 312 and 314 mounted on shaft 316 and drive shaft 318, respectively, and carried in housing 320. Housing 320 is preferably nonmetallic. Thus, a plastic material may be used, e.g., an acetal resin such as "Delrin" produced by DuPont. Drive shaft 316 extends through the housing 320 and is provided with a shaft seal 322, preferably formed of a synthetic ink resistant resin, e.g., a Neoprene, Teflon or Nylon O-ring seal coacting between the housing 320 and the drive shaft 318. It has been found that such a seal introduces no substantial drag and that leakage of ink through the seal is negligible.

At the outer end of the drive shaft 318 there is secured by any suitable means a driven magnet 324. To drive the gear pump 310 there is provided a small 24 volt D.C. powered electric motor (not shown) which is commercially available. This is carried in a housing 326 which is also provided with an enlarged housing portion 328 for the coupling. The armature shaft 330 of the D.C. motor is shown extending from the housing portion 326. To the free end of the shaft 330 there is selectively removably secured a cup 332 in which is carried a drive magnet 334. The magnets 324 and 334 are mounted for rotation about the same axis. Between the magnets 324 and 334 there is an unobstructed air gap 336. This assembly contains no sealing cup located between the magnets and within the air gap.

The magnets 324 and 334 are commercially available plural pole ceramic type permanent magnets such as those sold under the mark "Cera Magnet". These magnets may be a barium ferrite magnet, e.g., $BaFe_{12}O_{19}$, or a barium carbonate material containing a considerable mass of iron oxide.

One D.C. motor available commercially is capable of operating at 7000 rpm at 24 volts D.C. with a rated load of 140 milliamps. The rated torque is 32 inch-ounces.

The present coupling demonstrates little if any loss in torque through the coupling and virtually a 1:1 drive ratio. In the pump/motor units of the invention there is more torque available for pumping ink than with a system otherwise the same but having no shaft seal and including a metallic sealing cup disposed in the air gap between the driven and the drive magnets.

In FIGS. 9–12 there is shown an ink rail to which a plurality of the pump/motor assemblies shown in FIG. 14 may be attached. As indicated, the ink rail services a rotating roll, such as a roll in an inking train of a rotary press, for a distance along the roll equivalent to the width of a page, e.g., an eight column newspaper page. In such case, the ink rail carries eight pump/motor assemblies for delivering ink for each column individually. Several such ink feeding page packs may be provided along a common rotating ink-receiving roll of a printing press.

Figure 15:
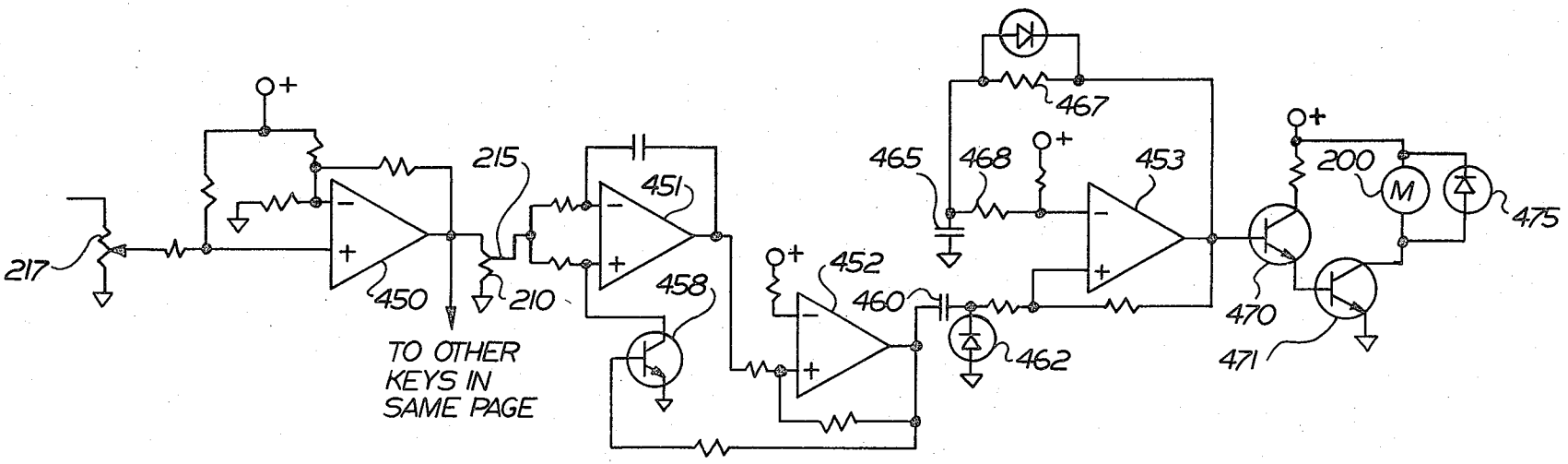
FIG. 15 is a schematic of a pulsing circuit useful in controlling ink flow in response to press speed.

The pulsing circuit is shown in detail in FIG. 15. The basic active elements in amplifier 214, integrator 223, Schmitt trigger 225 and one-shot 205 are current amplifiers identified by the numerals 450, 451, 452 and 453 respectively. These amplifiers are commercially available.

The signal from page pack potentiometer 217 is provided to the non-inverting input of current amplifier 450. The signal is amplified and transmitted as the control voltage to potentiometer 210 and to the corresponding potentiometer of the remaining pumps for the same page pack. The portion of the control voltage selected by wiper 215 of potentiometer 210 is provided to both inputs of amplifier 451 which is connected as the integrator 223 (FIG. 13). The output of amplifier 451 is a ramp voltage which is provided to the non-inverting input of amplifier 452. When the ramp voltage reaches a predetermined value, amplifier 452 saturates and turns on transistor 458 which returns the output of amplifier 451 to its reference level. This turns off amplifier 452 which turns off transistor 458.

The output signal from amplifier 452 is differentiated and rectified by capacitor 460 and diode 462 to provide a positive pulse to the non-inverting input of amplifier 453 which is connected as the one-shot 205 (FIG. 13). Amplifier 453 produces an output pulse having a duration determined by the value of capacitor 465 and resistors 467 and 468. The pulse from amplifier 453 is fed to the base of transistor 470 which is connected with transistor 471 as a Darlington pair forming the drive circuit 202 (FIG. 13). Transistors 470 and 471 are both rendered conductive for the duration of the pulse from amplifier 453 and transistor 471 drives motor 200 for that period. Diodes 475 provides a discharge path for the inductive winding of motor 200.

Preferably, transistors 470 and 471 and motor 200 are supplied from a separate power supply from the remaining circuitry so that voltage spikes will not be coupled to the other circuits.

What is claimed is:

1. A mechanism for applying ink to a rotating roll in a printing press, said mechanism comprising an ink rail extending along a length of said roll, a support for said ink rail, said ink rail having a plurality of ink-applying sections spaced axially along the roll, each of said sections extending circumferentially around a part of the roll, a plurality of individual continuous delivery pumps secured to said ink rail, each of said pumps having a respective individual speed controllable drive motor drivingly connected thereto, respective individual pumps being associated with an ink-applying section for providing a controlled, continuous flow of ink to its associated ink-applying section, means defining a fluid passage for delivering ink from each of said pumps to its associated ink-supplying section including an orifice for receiving ink from each of said respective pumps and which is located adjacent the periphery of said roll, the roll ripping the ink out of said orifice as said roll rotates relative thereto, the surface of each of said circumferentially extending ink-applying sections confronting the roll including a longitudinally extending recess and at least two longitudinally extending margins of said recess defining first and second circumferentially spaced gaps with said roll, said recess having a circumferential wall at a slightly greater radial distance from the axis of said rotating roll than said gaps, and into which recess the ink moves after being ripped from said orifice by said roll, and which recess provides a reservoir enabling the ink to cool therein prior to reaching the end of said ink-applying section.

2. A mechanism for applying ink to a rotating roll as defined in claim 1, wherein an ink supply passage in said ink rail detects ink from a supply to said pumps, and an ink delivery passage in said rail delivers ink to said orifice.

3. A mechanism as defined in claim 2, wherein said individual pumps are gear pumps, and each gear pump has an inlet port plate secured to a face of said ink rail.

4. A mechanism as defined in claim 3 wherein said ink rail has a common inlet passageway therein and ink-supply passages communicate fluid from said common inlet passageway to the inlet of said gear pumps, and further including a valve for controlling the flow of fluid into said common inlet passageway, said valve having a plurality of inlets adapted to different fluid supplies and said valve having a movable valve port for selectively communicating one of said inlets with the outlet of said valve.

5. A mechanism as defined in claim 4 wherein said valve is removably secured to a surface of said ink rail support and remains secured thereto upon removal of said ink rail from said ink rail support.

6. A mechanism for applying ink to a rotating roll in a printing press, said mechanism comprising an ink rail extending along the length of said roll, a support for said ink rail for supporting said ink rail adjacent said roll, means supporting said ink rail support for pivoting movement relative to said roll to enable said ink rail to be adjustably positioned relative to said ink roll, means for releasably securing said ink rail to said ink rail support, said ink rail having a plurality of ink-applying sections spaced axially along the roll, each of said sections extending circumferentially around a part of the roll, a plurality of individual continuous delivery gear pumps secured to said ink rail, each of said pumps having a separate speed controllable drive motor connected thereto, respective individual pumps being associated with different ink-applying sections for applying a controlled, continuous flow of ink to its associated ink-applying section, means defining a fluid passage for delivering ink from each of said pumps to said ink-applying section including an orifice for receiving ink from each of said respective pumps and which is located adjacent the periphery of said roll, the roll shearing the ink out of said orifice as the roll rotates relative thereto, the surface of each said circumferentially extending ink-applying section confronting the roll including a longitudinally extending recess between circumferentially spaced longitudinal margins thereof and into which recess the ink moves after being sheared from said orifice by said roll, and which recess provides a reservoir enabling the ink to cool therein prior to reaching the end of said ink-applying section, said longitudinal margins providing a pair of circumferentially spaced gaps relative to said roll and through which the ink must pass, means defining a manifold chamber communicating with a supply of ink, the distance of certain of said pumps from said manifold chamber being greater than the distance of others of said pumps, individual ink pump supply passages in said ink rail for conducting ink from said manifold chamber to said individual pumps, respectively, each of said pumps having an inlet, and only one pump inlet being connected with an ink pump supply passage, and ink delivery passages in said ink rail for delivering ink to said ink-applying sections from each of said pumps, said ink supply and ink delivery passages intersecting the same face of said ink rail, and said pumps being mounted on said face of said ink rail, means for controlling the ink delivery rate from said individual pumps including press speed sensing means, said control means being responsive in direct relation to the speed of the press as determined by said sensing means, and means for individually energizing said pump motors to deliver continuously an amount of ink proportional to the speed of operation of said printing press.

7. A mechanism for applying ink to a rotating roll in a printing press, said mechanism comprising an ink rail extending along the length of said roll, an ink rail support for supporting said ink rail adjacent said roll, said ink rail having a plurality of ink-applying sections located along the length of said ink rail, a plurality of individual, continuous delivery pumps secured to said ink rail and spaced along the length of said ink rail, an individual separately controllable drive motor for driving each pump independently of the remaining pumps, respective individual pumps being associated with individual ink-applying sections for providing a controlled continuous flow of ink to its associated ink-applying section, means defining a manifold chamber located centrally of said ink rail and communicating with an ink supply, the distance of certain of said pumps from said manifold chamber being greater than the distance of others of said pumps from said manifold chamber, individual ink pump supply passages in said ink rail communicating between said centrally located manifold chamber and said individual pumps, respectively, for conducting ink from said manifold chamber to said individual pumps, respectively, each of said ink pump supply passages having passage portions for directing ink generally parallel and radially relative to the axis of said roll, each of said ink pump supply passages communicating with said manifold chamber at locations spaced different distances from the axis of said ink roll, each of said pumps having an inlet, only one pump inlet being connected with a given ink pump supply passage, and respective ink delivery passages in said ink rail for delivering ink to said respective ink-applying sections from each of said respective pumps.

8. A mechanism for applying ink to a rotating roll in a printing press, said mechanism comprising an ink rail extending axially of said roll, said ink rail having ink delivery and supply passages therein, means for supporting said ink rail in ink delivering relation to said rotating roll, said ink rail including a plurality of axially spaced ink delivery stations, each of said stations including an ink applying section extending circumferentially around a part of the roll, respective gear pumps mounted on said ink rail at each of said ink delivery stations, each of said gear pumps comprising means for continuously receiving ink from a supply passage in said ink rail and continuously forcing ink through a delivery passage in said ink rail to said ink applying section for pickup by said rotating roll, a respective electric motor for driving each respective gear pump, said electric motors being mounted with said gear pumps on said ink rail, and means for controlling the speed of each motor for each pump to provide a continuous flow of ink from each pump independently of the flow from every other pump so that different amounts of ink may be applied to different axially spaced areas of said roll, said ink rail having a manifold chamber located centrally thereof and each of said supply passages communicating with said manifold chamber and with inlet ports of said gear pumps, said supply passages communicating with said manifold chamber at locations spaced radially different distances from the axis of said rotating roll.

* * * * *

UNITED STATES PATENT AND TRADEMARK OFFICE

CERTIFICATE OF CORRECTION

PATENT NO. : 4,281,597

DATED : August 4, 1981

INVENTOR(S) : Friedrich K. Dressler

It is certified that error appears in the above-identified patent and that said Letters Patent are hereby corrected as shown below:

Column 11, line 54, change "detects" to --directs--.

Signed and Sealed this

*Twentieth* Day of *October 1981*

[SEAL]

*Attest:*

GERALD J. MOSSINGHOFF

*Attesting Officer*

*Commissioner of Patents and Trademarks*